United States Patent [19]

Hayashi

[11] Patent Number: 4,469,023

[45] Date of Patent: Sep. 4, 1984

[54] CROSS HAMMER TYPE PRINTER HEAD

[75] Inventor: Mikio Hayashi, Tokyo, Japan

[73] Assignee: Seikosha Co., Ltd., Tokyo, Japan

[21] Appl. No.: 379,905

[22] Filed: May 19, 1982

[30] Foreign Application Priority Data

May 20, 1981 [JP] Japan ..... 56-76025

[51] Int. Cl.[3] ..... B41J 9/02

[52] U.S. Cl. ..... 101/93.48; 101/93.04

[58] Field of Search ..... 101/93.04, 93.09, 93.15, 101/93.16, 93.48, 93.29–93.34; 400/121, 157.2

[56] References Cited

U.S. PATENT DOCUMENTS

| | | | |
|---|---|---|---|
| 3,748,613 | 7/1973 | Venrer | 101/93.29 X |
| 3,804,008 | 4/1974 | Hoyer | 101/93.04 |
| 3,810,195 | 5/1974 | Kilroy et al. | 101/93.04 X |
| 3,968,867 | 7/1976 | Stenudd | 101/93.04 |
| 4,224,589 | 9/1980 | Tamulis | 101/93.48 |
| 4,351,235 | 9/1982 | Bringhurst | 101/93.04 |
| 4,362,405 | 12/1982 | Ikeda | 101/93.04 |

FOREIGN PATENT DOCUMENTS

| | | | |
|---|---|---|---|
| 2848028 | 5/1979 | Fed. Rep. of Germany | 400/157.2 |
| 80486 | 7/1981 | Japan | 101/93.34 |
| 80484 | 7/1981 | Japan | 101/93.34 |
| 167459 | 12/1981 | Japan | 101/93.04 |

*Primary Examiner*—Edgar S. Burr
*Assistant Examiner*—John A. Weresh
*Attorney, Agent, or Firm*—Robert E. Burns; Emmanuel J. Lobato; Bruce L. Adams

[57] ABSTRACT

A cross hammer type dot printer comprises a rotary drum having an outer peripheral surface formed with a plurality of projections extending along its longitudinal axis, and a printer head disposed in front of the drum and movable in a direction which is perpendicular to the direction in which a recording medium is fed. The printer head faces the drum in a way in which it substantially crosses the projections on the drum, and includes an electromagnetically operable printing hammer. The projections are displaceable vertically relative to the printing hammer upon rotation of the drum, while the printing hammer is horizontally displaceable relative to the projections upon movement of the printer head, so that when the hammer strikes against the projections, dots are printed where they cross each other. The printer head of this invention is suitable for use in such a cross hammer type dot printer. It can be made of a small number of parts, and is small.

5 Claims, 5 Drawing Figures

CROSS HAMMER TYPE PRINTER HEAD

BACKGROUND OF THE INVENTION

1. Filed of the Invention

This invention relates to a novel cross hammer type printer head of the releasable resilient arm type in which a coil provided in the magnetic circuit of a permanent magnet is energized to cancel its magnetic force urging a resilient arm rearwardly to release it from the magnetic force to thereby drive a printing hammer.

2. Description of the Prior Art

In a conventionally known printer head of the releasable resilient arm type, a magnetic circuit device including a permanent magnet has at least one open end in a yoke assembly in addition to an air gap in which a movable yoke is disposed. The device has a low magnetic efficiency due to the leakage of a magnetic flux through the open end, and requires a large magnet to produce a strong magnetic force. The known printer head is, moreover, composed of a large number of parts, and is difficult to fabricate and expensive to manufacture.

SUMMARY OF THE INVENTION

It is an object of this invention to provide a cross hammer type printer head which is composed of a smaller number of parts and which is easier to manufacture than comparable prior art devices.

It is another object of this invention to provide a cross hammer type dot printer which is superior in magnetic efficiency and can be driven at a high speed.

DETAILED DESCRIPTION OF THE INVENTION

Figure 1:
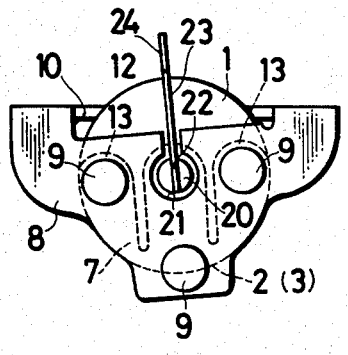
FIG. 1 is a front elevational view of a cross hammer type dot printer embodying this invention.
Figure 2:
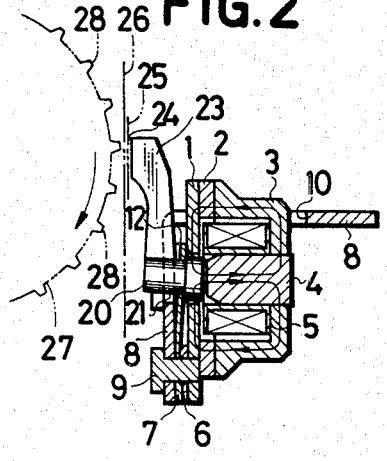
FIG. 2 is a cross sectional view thereof.

Referring to FIGS. 1 and 2 of the drawings, there is shown a magnetic circuit device which comprises a front yoke 1, a permanent magnet 2, a rear yoke 3 and a central yoke 4. The front yoke 1 is substantially circular, and has a hole in its center. The permanent magnet 2 is annular, and secured to the rear surface of the front yoke 1. The rear yoke 3, which is secured to the rear surface of the permanent magnet 2, is in the form of a cylindrical cap, and the central yoke 4, which is columnar, is secured to the bottom of the rear yoke 3. The central yoke 4 extends toward the central hole of the front yoke 1. A release coil 5 is disposed in the hollow interior of the permanent magnet 2 and the rear yoke 3, and surrounds the central yoke 4.

Figure 3:
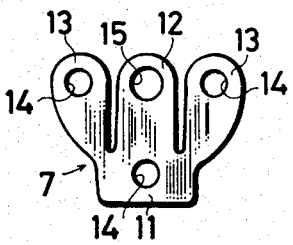
FIG. 3 is a front elevational view of a plate member having a resilient arm.
Figure 4:
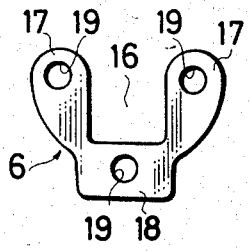
FIG. 4 is a front elevational view of a spacer plate.
Figure 5:
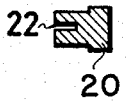
FIG. 5 is a cross sectional view of a movable yoke.

A spacer plate 6, a plate member 7 and a supporting plate 8 are secured by pins 9 to the front surface of the front yoke 1. The supporting plate 8 is L-shaped in cross section, and has a recess 10 above which the top of the magnetic circuit device projects. The plate member 7 has a base 11, a centrally disposed cantilevered resilient arm 12 having a proximal end extending from the base 11 and having a free distal end, and a pair of supporting portions 13 extending from the base 11 and between which the resilient arm 12 is positioned. Each of the base 11 and the supporting portions 13 is provided with a hole 14 for a mounting pin 9, and the arm 12 is also formed at its distal end with a hole 15, as shown in FIG. 3. The spacer plate 6 mounts the plate member 7 to the front yoke 1, and has a thickness defining a distance by which the plate member 7 is spaced apart from the front yoke 1. The spacer plate 6 has a base 18, and a pair of supporting portions 17 extending from the base 18, and between which a recess 16 is defined in a position corresponding to the position of the arm 12 of the plate member 7, as shown in FIG. 4. Each of the supporting portions 17 and the base 18 is provided with a hole 19 for a mounting pin 9. A movable yoke 20, which is formed from magnetic material, is secured in the hole 15 so as to be carried by the arm 12 in the plate member 7, as shown in FIGS. 1 and 2. The movable yoke 20 has a rear end disposed in the central hole of the front yoke 1. The movable yoke 20 is, thus, magnetically attracted by the central yoke 4, so that the arm 12 may be urged rearwardly against its own resilient force. The movable yoke 20 has a front end projecting forwardly through a central opening 21 in the supporting plate 8. The movable yoke 20 is provided at its front end with a slit 22 as shown in FIG. 5, and a printing hammer 23 in the form of a plate has a lower end clamped in the slit 22. The printing hammer 23 has an upper end formed with a striking surface 24 facing a rotary drum 27. An ink ribbon 25 and a recording medium 26 are disposed between the striking surface 24 and the drum 27. The rotary drum 27 has a length which is greater than the width of the recording medium 26. A plurality of projections 28 extending along the length of the drum 27 are provided on the outer periphery of the drum 27, and face the striking surface 24 in a way substantially crossing it. The projections 28 are vertically displaceable relative to the striking surface 24 upon rotation of the drum 27, while the striking surface 24 is horizontally displaceable relative to the projections 28 by the spacing of a carriage, not shown, on which the printing head is mounted.

A magnetic flux created by the permanent magnet 2 passes through the front yoke 1, the rear yoke 3, the central yoke 4 and the movable yoke 20 as shown by arrowlines in FIG. 2. The movable yoke 20 is magnetically attracted by the front surface of the central yoke 4 by overcoming the resilient force of the arm 12 so as to resiliently flex the arm 12 in the reverse direction to position the printing hammer 23 in a non-printing rest position as shown in FIG. 2. If an electric current is applied to the coil 5 to cancel the magnetic flux, the movable yoke 20 is released from attraction by the central yoke 4, and is moved forward by the spring force of the arm 12. The printing hammer 23 also moves forward to a printing position, and its striking surface 24 presses the ink ribbon 25 and the recording medium 26 impulsively against the projections 28 on the drum 27, whereupon a dot is printed on the recording medium 26 at a point thereof in which the striking surface 24 and a particular projection 28 cross each other.

According to the printer head of this invention as hereinabove described, the magnetic flux created by the magnet 2 passes along a path having an angle of 360° through the front yoke 1 and the rear end of the movable yoke 20 and is concentrated in the central yoke 4, and returns along a path having an angle of 360° from the central yoke 4 to the permanent magnet 2 through the rear yoke 3. There is, thus, no appreciable leakage of the magnetic flux. Therefore, the magnet 2 can be small, and yet, provide a strong magnetic circuit, thereby enabling the use of a small magnetic circuit device. The movable yoke 20 and the printing hammer 23 can be driven at a high speed. The forward movement of the arm 12 is restrained and restricted by the rear surface of the supporting plate 8. The action of the supporting plate 8 for stopping the arm 12, therefore, proceeds progressively from its lower or proximal end to its upper or distal end portion in conjunction with the forward displacement of the arm 12. Therefore, the arm 12 does not produce any striking sound when it abuts on the supporting plate 8, nor does any excessive stress, or large repeated stress, act on the arm 12. The arm 12 is, thus, reliable for fast response, and highly durable. The printer head of this invention is simple in construction, comprises only a small number of parts, and is easy and inexpensive to manufacture. It is a very small printer head. The printer head shown in the drawings is twice as large as it actually is.

What is claimed is:

1. A printer head comprising: a resiliently flexible arm having distal and proximal ends; means mounting the proximal end of the arm to enable resilient flexing movement of the arm in forward and reverse directions accompanied by movement of the distal end of the arm; a movable magnetic yoke carried by the distal end of the arm for movement therewith; a printing hammer secured to the movable yoke and movable between printing and non-printing positions in response to flexing movement of the arm; magnetic means coacting with the yoke for magnetically attracting the yoke to thereby effect resilient flexing of the arm in the reverse direction to move the printing hammer to the non-printing position; electromagnetic means for selectively cancelling the magnetic attraction of the yoke to enable resilient flexing of the arm in the forward direction to thereby move the printing hammer to the printing position; and a restraining plate member progressively engageable with the front surface of the arm along the length thereof during flexing movement of the arm in the forward direction for restraining the forward movement of the arm in a progressively increasing manner to thereby prevent unwanted stressing of the arm during forward movement thereof.

2. A printer head according to claim 1; wherein the restraining plate member has a surface portion extending in opposed facing relation with respect to the arm, the plate member being connected to the arm in the region of the proximal end such that the plate member surface portion permanently engages with the proximal end of the arm and progressively engages with the arm along the length thereof in the direction toward the distal end thereof during the course of flexing movement of the arm in the forward direction.

3. A printer head according to claim 2; wherein the plate member comprises part of the mounting means.

4. A printer head according to claim 2; wherein the surface portion of the plate member extends the full length of the arm.

5. A printer head according to claim 2; wherein the surface portion of the plate member extends beyond the distal end of the arm, and means defining an opening in the plate member through which extends the movable yoke.

* * * * *